US010381699B2

(12) United States Patent
Fraysse et al.

(10) Patent No.: US 10,381,699 B2
(45) Date of Patent: Aug. 13, 2019

(54) COMPACT BIPOLARIZATION EXCITATION ASSEMBLY FOR A RADIATING ANTENNA ELEMENT AND COMPACT ARRAY COMPRISING AT LEAST FOUR COMPACT EXCITATION ASSEMBLIES

(71) Applicant: THALES, Courbevoie (FR)

(72) Inventors: Jean-Philippe Fraysse, Toulouse (FR); Ségolène Tubau, Toulouse (FR); François Doucet, Toulouse (FR); Hervé Legay, Plaisance du Touch (FR); Renaud Chiniard, Mourvilles Basses (FR)

(73) Assignee: THALES, Courbevoie (FR)

( * ) Notice: Subject to any disclaimer, the term of this patent is extended or adjusted under 35 U.S.C. 154(b) by 166 days.

(21) Appl. No.: 15/369,630

(22) Filed: Dec. 5, 2016

(65) Prior Publication Data

US 2017/0170570 A1 Jun. 15, 2017

(30) Foreign Application Priority Data

Dec. 11, 2015 (FR) ..... 15 02571

(51) Int. Cl.
*H01P 1/161* (2006.01)
*H01P 1/165* (2006.01)
(Continued)

(52) U.S. Cl.
CPC ..... *H01P 1/161* (2013.01); *H01P 1/165* (2013.01); *H01P 1/182* (2013.01); *H01P 1/2131* (2013.01);
(Continued)

(58) Field of Classification Search
CPC ..... H01P 1/161; H01P 1/066; H01P 1/067; H01P 1/171; H01P 1/182; H01P 1/165;
(Continued)

(56) References Cited

U.S. PATENT DOCUMENTS 6,037,910 A 3/2000 Solbach et al.
6,087,908 A 7/2000 Haller et al.
(Continued)

FOREIGN PATENT DOCUMENTS

FR 2 959 611 A1 11/2011
FR 3 012 917 A1 5/2015

OTHER PUBLICATIONS

Juan L. Cano et al., "Full band waveguide turnstile junction orthomode transducer with phase matched outputs," International Journal of RF and Microwave Computer-Aided Engineering, Feb. 12, 2010, XP055305110.

*Primary Examiner* — Rakesh B Patel
*Assistant Examiner* — Jorge L Salazar, Jr.
(74) *Attorney, Agent, or Firm* — Baker & Hostetler LLP

(57) ABSTRACT

An excitation assembly comprises a symmetrical OMT and two splitters respectively connected to two pathways of the OMT. The OMT comprises a cross junction comprising a central waveguide parallel to an axis Z and four lateral ports oriented in two directions X, Y, the first splitter consisting of an input waveguide and of two output ports coupled to two lateral ports, oriented in the direction X, by respective connection waveguides. The first splitter is located on a lateral side of the OMT, orthogonally to the direction X, and its two output ports are formed one above the other in a lateral wall of the input waveguide, the upper output port being placed facing a first lateral port of the OMT to which it is connected by the first connection waveguide. The difference in electrical length between the two connection waveguides is equal to λ/2.

9 Claims, 6 Drawing Sheets

(51) Int. Cl.

| | |
|---|---|
| ***H01P 1/18*** | (2006.01) |
| ***H01P 3/12*** | (2006.01) |
| ***H01P 5/12*** | (2006.01) |
| ***H01Q 13/02*** | (2006.01) |
| ***H01Q 21/24*** | (2006.01) |
| ***H01P 1/213*** | (2006.01) |

(52) U.S. Cl.
CPC ..... *H01P 3/12* (2013.01); *H01P 5/12* (2013.01); *H01Q 13/0208* (2013.01); *H01Q 21/245* (2013.01); *H01Q 21/24* (2013.01)

(58) Field of Classification Search
CPC . H01P 1/2131; H01P 5/12; H01P 3/12; H01Q 13/0208; H01Q 21/245; H01Q 21/24
USPC ..... 333/21 A, 126, 135
See application file for complete search history.

(56) References Cited

U.S. PATENT DOCUMENTS

| | | | | |
|---|---|---|---|---|
| 7,397,323 | B2 * | 7/2008 | Tavassoli Hozouri | H01P 1/161 333/117 |
| 8,816,930 | B2 * | 8/2014 | Fonseca | H01P 1/161 333/137 |
| 2005/0040914 | A1 | 2/2005 | Chambelin et al. | |
| 2014/0266934 | A1 * | 9/2014 | Cook | H01Q 1/44 343/720 |

* cited by examiner

COMPACT BIPOLARIZATION EXCITATION ASSEMBLY FOR A RADIATING ANTENNA ELEMENT AND COMPACT ARRAY COMPRISING AT LEAST FOUR COMPACT EXCITATION ASSEMBLIES

CROSS-REFERENCE TO RELATED APPLICATIONS

This application claims priority to foreign French patent application No. FR 1502571, filed on Dec. 11, 2015, the disclosure of which is incorporated by reference in its entirety.

FIELD OF THE INVENTION

The present invention relates to a compact bipolarization excitation assembly for a radiating antenna element and a compact array comprising at least four compact excitation assemblies. It applies to any multiple-beam antenna comprising a focal array operating in low frequency bands and more particularly to the field of space applications such as satellite telecommunication in band C, or in band L, or in band S, and to the space antennas with single-beam global coverage in band C, or in band L, or in band S. It applies also to the radiating elements for array antennas, notably in band X or in band Ka.

BACKGROUND

The radiating feeds operating in low frequency bands, for example in band C, generally comprise very bulky metal horns of significant weight. To reduce the size of the radiating feed, it is known practice, from the document FR2959611, to replace the metal horn with stacked Fabry-Pérot cavities. This solution makes it possible to reduce the size of the feeds and exhibits radio frequency performance levels equivalent to those of a metal horn. However, this solution is limited to an aperture diameter less than 2.5λ, where λ represents the central wavelength, in vacuum, of the frequency band of use.

In order to produce compact feeds of greater radiating aperture, the document FR 3012917 proposes a solution comprising a compact bipolarization power splitter comprising four asymmetrical orthomode transducers OMT, coupled in phase to a power source with dual orthogonal polarization. These four OMTs are networked together via two power distributers dedicated to each polarization. This power splitter has a very small thickness when the OMTs and the two power distributers are situated in one and the same plane. This solution does however present the drawback of a mediocre isolation, of the order of 15 dB, between the two orthogonal modes of each OMT, which results in inadequate performance levels for the power splitter. This isolation defect between the two orthogonal modes of each OMT is essentially due to the asymmetry of each OMT which comprises only two lateral access ports spaced apart angularly by 90° about a main waveguide.

SUMMARY OF THE INVENTION

The aim of the invention is to resolve the problems of the existing solutions and to propose an alternative solution to the existing radiating elements, having a radiating aperture diameter of average size lying between 2.5λ and 5λ, comprising a good isolation between the orthogonal modes, low losses and being compatible with high-power applications.

For that, the invention relates to a compact bipolarization excitation assembly consisting of an orthomode transducer OMT comprising two transmission pathways respectively dedicated to two orthogonal polarizations, a first and a second power splitter respectively connected to the two transmission pathways of the OMT, and a first and a second connection waveguide, the OMT consisting of a cross junction comprising a central waveguide parallel to an axis Z and four lateral ports respectively coupled to the central waveguide and oriented in two directions X and Y orthogonal to one another and to the axis Z. The first power splitter consists of an input waveguide and of two output ports respectively coupled to a first and a second lateral port of the OMT, oriented in the direction X, via the first and the second respective connection waveguide. The first power splitter is located on a first lateral side of the OMT, the input waveguide having a lateral wall orthogonal to the direction X and extending heightwise parallel to the axis Z. The two output ports, respectively upper and lower, of the first power splitter are formed one above the other in the height of said lateral wall of the input waveguide, the upper output port being placed facing the first lateral port of the OMT to which it is connected by the first connection waveguide, and the first and second connection waveguides have different electrical lengths, the difference in electrical length between the first and second connection waveguides being equal to a half-wavelength λ/2, where λ is the central wavelength of operation.

Advantageously, the excitation assembly can comprise several levels stacked parallel to the plane XY, the OMT and the first connection waveguide being located in a first level, the second connection waveguide consisting of a linear section located in a second level, under the orthomode transducer, and of a section bent to 180° connected to the second lateral port of the OMT.

Advantageously, the second power splitter can be identical to the first power splitter and located on a second lateral side of the OMT, orthogonally to the direction Y.

Advantageously, the second power splitter can consist of an input waveguide and of two output ports formed one above the other in a lateral wall of the input waveguide and respectively coupled to a third and a fourth lateral port of the OMT, oriented in the direction Y, via a third and a fourth respective connection waveguide, and the third and fourth connection waveguides have different electrical lengths, the difference in electrical length between the third and fourth connection waveguides being equal to a half-wavelength λ/2.

Advantageously, the fourth connection waveguide can consist of a linear section located in a third level, under the orthomode transducer, and of a section bent to 180° connected to the fourth lateral port of the OMT.

Advantageously, the OMT can comprise a symmetrical pyramid situated at the center of the cross junction.

Alternatively, the second power splitter can be a septum splitter consisting of an input waveguide provided with an inner wall, called septum, delimiting two output waveguides parallel to the input waveguide and stacked in a fourth level under the OMT, parallel to the plane XY, the two output waveguides of the septum power splitter being respectively connected to the first and to the second lateral ports of the OMT by fifth and sixth respective connection waveguides located in a third level, under the OMT, the electrical lengths of the fifth and sixth connection waveguides being equal. In this case, advantageously, the OMT can comprise a dissymmetrical pyramid situated at the center of the cross junction.

The invention also relates to a compact array comprising at least four compact excitation assemblies coupled to one another by two common power splitters, independent of one another, orthogonal to one another, and respectively dedicated to the two orthogonal polarizations.

BRIEF DESCRIPTION OF THE DRAWINGS

Other particular features and advantages of the invention will become clearly apparent hereinafter in the description given by way of purely illustrative and non-limiting example, with reference to the attached schematic drawings which represent.

DETAILED DESCRIPTION

Figure 1:
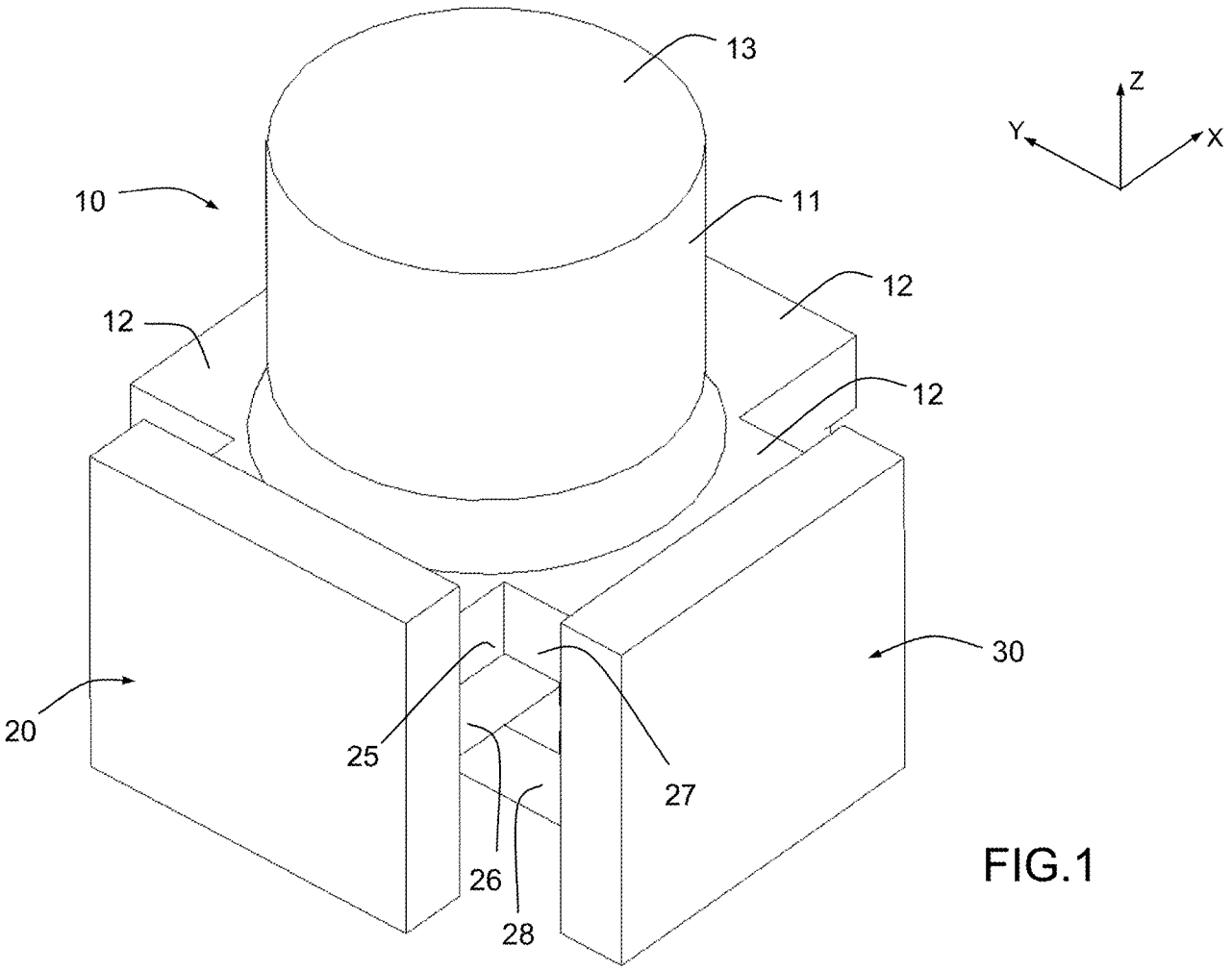
FIG. 1: a perspective diagram of an exemplary compact excitation assembly according to a first embodiment of the invention.

FIG. 1 represents a first exemplary compact bipolarization excitation assembly according to the invention. The excitation assembly, produced in waveguide technology, comprises several levels stacked one on top of the other, parallel to a plane XY. The excitation assembly comprises an orthomode transducer OMT 10 and two power splitters 20, 30 respectively connected to the orthomode transducer, by dedicated connection waveguides. The orthomode transducer OMT 10, situated in a first level, consists of a cross junction, known as a "turnstile" junction, comprising a central waveguide 11 for example of cylindrical geometry, having an axis of revolution parallel to an axis Z, and four lateral waveguides 12, for example of rectangular section, diametrically opposite two-by-two, in a plane XY orthogonal to the axis Z, and coupled at right angles to the central waveguide. The four lateral waveguides are respectively oriented in two orthogonal directions X, Y of the plane XY. The central waveguide 11 is provided with an axial access port 13 and the four lateral waveguides are respectively provided with four lateral ports oriented in the directions X or Y. In transmission, the four lateral ports are input ports and the axial access port is an output port. In reception, the input and output ports are reversed and the operation of the OMT is reversed. The two lateral waveguides oriented in the direction X and the two lateral waveguides oriented in the direction Y constitute two pathways of the OMT respectively dedicated to two orthogonal polarizations P1, P2. The two pathways generate two different propagation modes in the central waveguide 11 of the OMT. As represented in FIGS. 2*a*, 2*b*, 3*a*, 3*b*, advantageously, the OMT can further comprise a matching element, for example in the form of a cone or pyramid 14, placed at the center of the cross junction and comprising a summit penetrating into the central waveguide 11, in order to improve the matching of the junction to a predetermined frequency band of operation and improve the isolation between the two polarizations. The pyramid 14 or the cone makes it possible to accompany the electrical field E transmitted by each lateral waveguide of the OMT to the central waveguide 11 and constitutes an obstacle to the passage of the electrical field E to the lateral waveguides at right angles. To obtain an optimal operation of the orthomode transducer, the two lateral waveguides of each pathway of the OMT must be supplied by electrical fields E of the same amplitude but in phase opposition as FIGS. 2*a*, 2*b*, 3*a*, 3*b* show.

The power splitters operate as dividers in transmission and, in reverse, as combiners in reception. With the operation of each power splitter in reception being reversed with respect to transmission, the rest of the description is limited to the operation in transmission. The first power splitter 20 comprises, in transmission, an input waveguide, of rectangular section, comprising an input port 21 that can be linked a supply source operating in a first polarization P1 and two output ports 22, 23, respectively upper and lower, formed in a lateral wall of the input waveguide. Said lateral wall is orthogonal to the input port 21 and extends heightwise parallel to the axis Z, the two output ports being respectively connected to a first and a second lateral port 15, 16, diametrically opposite, of the orthomode transducer as FIG. 2*a* shows.

The two output ports of the first power splitter 20 are arranged one below the other, in the height of the lateral wall of the input waveguide which constitutes a first output plane parallel to the axis Z and orthogonal to the direction X. By construction, the electrical fields E on the two output ports 22, 23 of the first power splitter 20 are in phase opposition. To limit the bulk of the excitation assembly, the first power splitter 20 is located on a lateral side of the orthomode transducer 10, such that the upper output port 22 is placed in the plane XY, facing a first lateral port 15 of the orthomode transducer to which it is connected by a first connection waveguide 25. The lower output port 23 of the first power splitter 20 is linked to a second lateral port 16 of the orthomode transducer, diametrically opposite the first lateral port, by a second connection waveguide 26. The second connection waveguide 26 consists of a linear section located in a second level, under the orthomode transducer, in a plane parallel to the plane XY, and of a bent section, forming a 180° turn, connected to the second lateral port 16 of the OMT. For the first and the second lateral ports of the OMT to be supplied by electrical fields E in phase opposition, the second connection waveguide 26 has a total electrical length greater than the electrical length of the first connection waveguide 25, the difference in electrical length between the first and the second connection waveguides being equal to a half-wavelength $\lambda/2$, where $\lambda$ is the central wavelength of the frequency band of operation of the excitation assembly. Thus, the cumulative phase-shift due to the difference in electrical length and to the turn is equal to 360° and the electrical fields E on the first and second lateral ports are in phase opposition.

Regarding the second pathway of the OMT dedicated to the second polarization P2, the structure of the second power splitter 30 is chosen as a function of the desired application. Either the two pathways of the OMT operate in one and the same frequency band, for example transmission Tx, or they operate in two different frequency bands, for example transmission Tx and reception Rx.

Figure 2B:
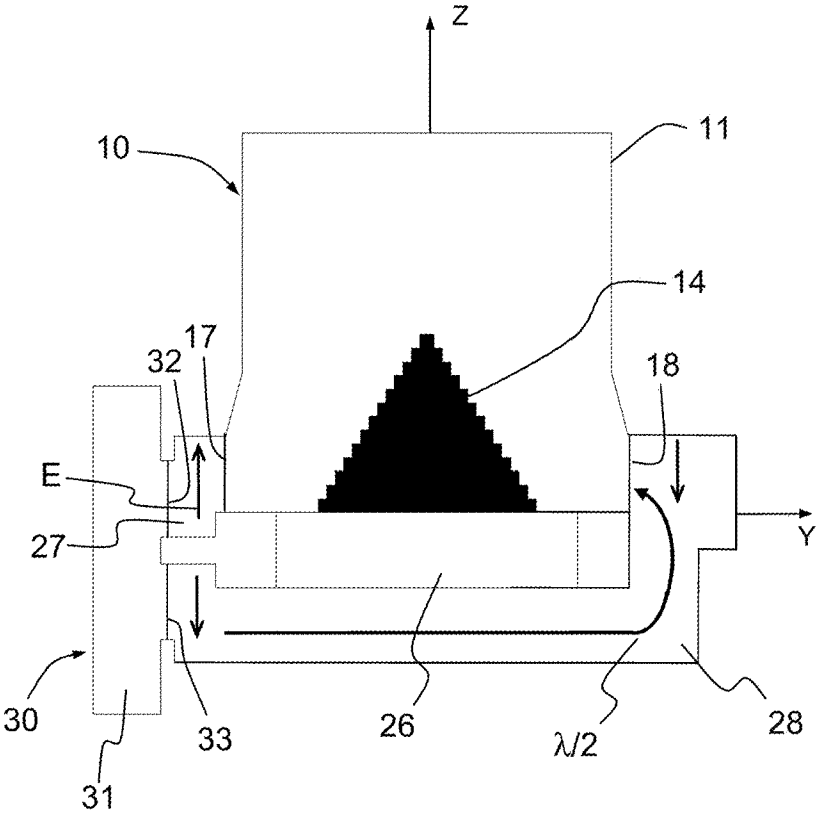
FIGS. 2*a* and 2*b*: two sectional diagrams, respectively along two orthogonal planes XZ and YZ, of the compact excitation assembly of FIG. 1, according to the invention.
Figure 2A:
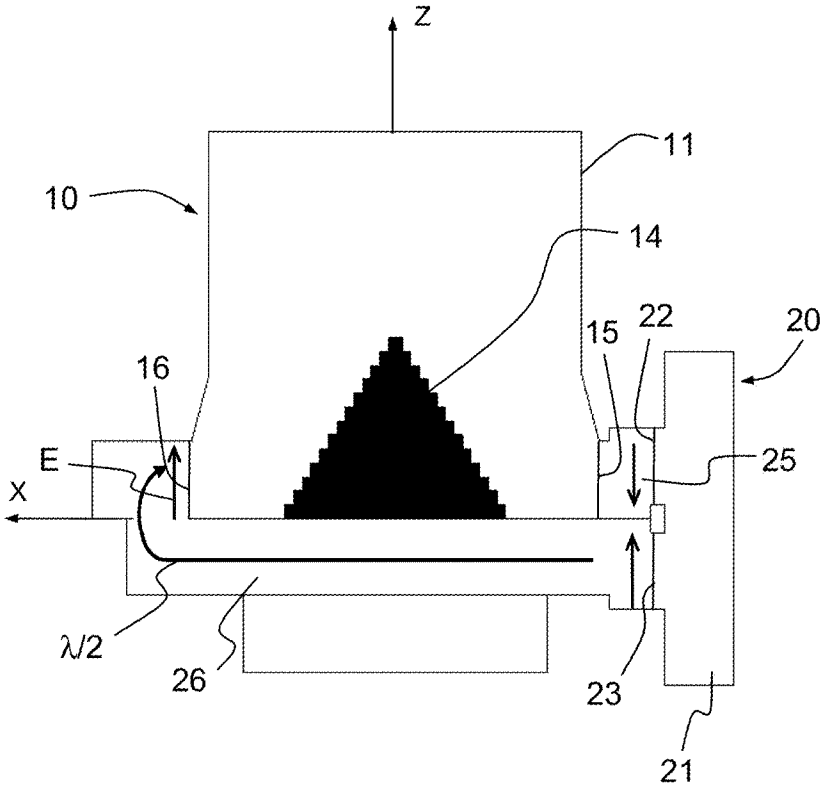

According to a first embodiment corresponding to an operation of the two pathways in the same frequency band, as represented in FIGS. 1 and 2*b*, the second power splitter 30 can be identical to the first power splitter 20, the two power splitters extending heightwise parallel to the axis Z and being respectively arranged at right angles to the two directions X and Y. The second power splitter 30 then comprises an input waveguide and two output ports formed one above the other in a lateral wall of said input waveguide. The two output ports 32, 33, upper and lower, are respectively connected to a third and fourth lateral port 17, 18 of the OMT, dedicated to the second polarization P2, via a third and a fourth connection waveguide. In this case, the two output ports 32, 33 of the second power splitter 30 are arranged one below the other in the heightwise direction of the second power splitter, in a second output plane parallel to the axis Z and orthogonal to the direction Y. The upper output port 32 of the second power splitter is placed in the plane XY, facing a third lateral port 17 of the orthomode transducer to which it is connected by a third connection guide 27. The lower output port 33 of the second power splitter is linked to a fourth lateral port 18 of the orthomode transducer, diametrically opposite the third lateral port, by a fourth connection waveguide 28. The fourth connection waveguide 28 is located in a third level situated under the second connection waveguide 26, on a plane parallel to the plane XY, and comprises a first linear section and a second section bent to 180° connected to the fourth lateral port 18 of the OMT. For the electrical fields E of the third and fourth lateral ports 17, 18 of the OMT to be in phase opposition, the fourth connection waveguide 28 has a total electrical length greater than the electrical length of the third connection waveguide 27, the difference in electrical length between the third and the fourth connection waveguides being equal to a half-wavelength $\lambda/2$.

In this first embodiment, the two pathways of the OMT operate in orthogonal polarizations P1, P2 and in the same frequency band. The geometry of the pyramid 14 of the OMT is symmetrical, its four faces being identical and having dimensions optimized according to the desired operating frequency. The lateral and connection waveguides, of rectangular section, have identical widths.

This very compact excitation assembly, produced in rectangular or cylindrical metal waveguide technology, makes it possible, in a small bulk, to excite, in dual polarization, a radiating element coupled to the axial access port 13 of the OMT and offers the advantages of operating at high radio frequency RF powers and of having a bandwidth compatible with the transmission frequency band between 3.7 GHz and 4.2 GHz and corresponding to band C.

However, because of the constraints on the electrical lengths of the connection waveguides linking the power splitters to the input ports of the OMT and the constraints on the widths of the metal waveguides as a function of the operating frequency, the compact excitation assembly according to this first embodiment can operate only in frequency bands close to one another for the two pathways, or in a single frequency band common to the two pathways of the OMT.

Figure 3B:
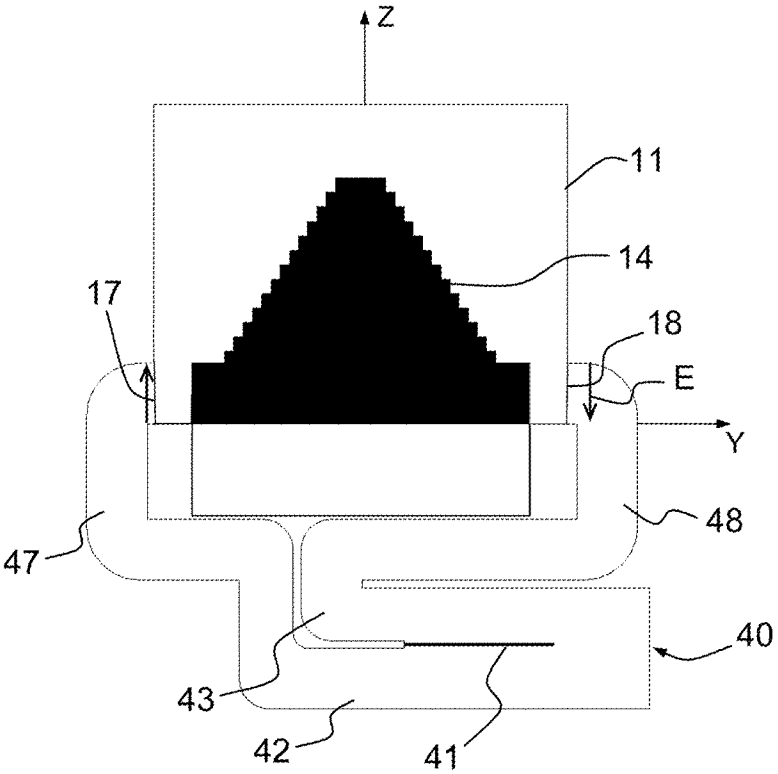
FIGS. 3*a* and 3*b*: two sectional diagrams, respectively along two orthogonal planes XZ and YZ, of an exemplary compact excitation assembly, according to a second embodiment of the invention.
Figure 3A:
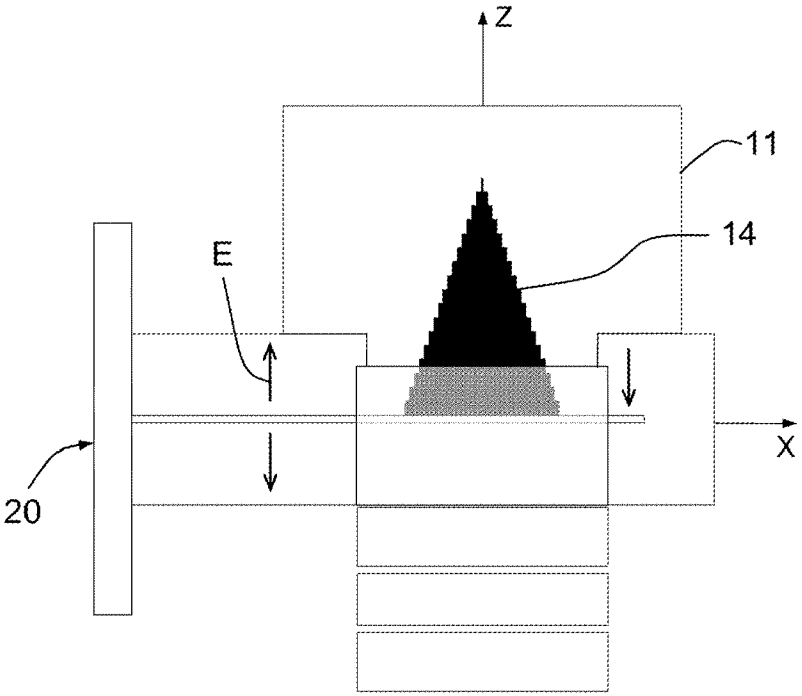

According to a second embodiment represented in FIGS. 3*a* and 3*b*, corresponding to an operation of the two pathways of the OMT in two different and distinct frequency bands, the second power splitter 30 can have a structure that is different from the first power splitter 20. For example, the two frequency bands can correspond to a transmission band Tx and respectively to a reception band Rx. In FIG. 3*b*, the second power splitter is a septum splitter 40 mounted in a fourth level, under the OMT. The septum splitter 40 comprises an input waveguide provided with an inner wall 41, called septum, delimiting two output waveguides 42, 43. The septum 41 can be resistive to improve the isolation between the two output waveguides. The two output waveguides 42, 43 are parallel to the input waveguide and stacked parallel to the plane XY. The two output waveguides of the septum power splitter are respectively connected to the third and fourth lateral ports 17, 18 of the OMT by fifth and sixth respective connection waveguides 47, 48 located in a third level, under the OMT, the electrical lengths of the fifth and sixth connection waveguides being equal. In this second embodiment, in order to allow an optimized operation in the two frequency bands of operation, the transmission frequency band being different from the reception frequency band, the widths of the lateral and connection waveguides dedicated to transmission are different from the widths of the waveguides dedicated to reception. For example, for operation in band C with a transmission frequency band of between 3.7 and 4.2 GHz and a reception frequency band of between 5.9 and 6.4 GHz, the wavelength of operation in reception is less than the wavelength of operation in transmission and the widths of the waveguides dedicated to the transmission pathway are therefore greater than the widths of the waveguides dedicated to the reception pathway. Furthermore, the geometry of the pyramid 14 of the OMT is dissymmetrical, as FIGS. 3*a* and 3*b* show, two of its four faces having smaller dimensions, optimized for operation in the reception frequency band and the other two faces having larger dimensions, optimized for operation in the transmission frequency band. In particular, seen from the lateral rectangular waveguides of the OMT, the pyramid is wider in transmission than in reception.

Figure 4:
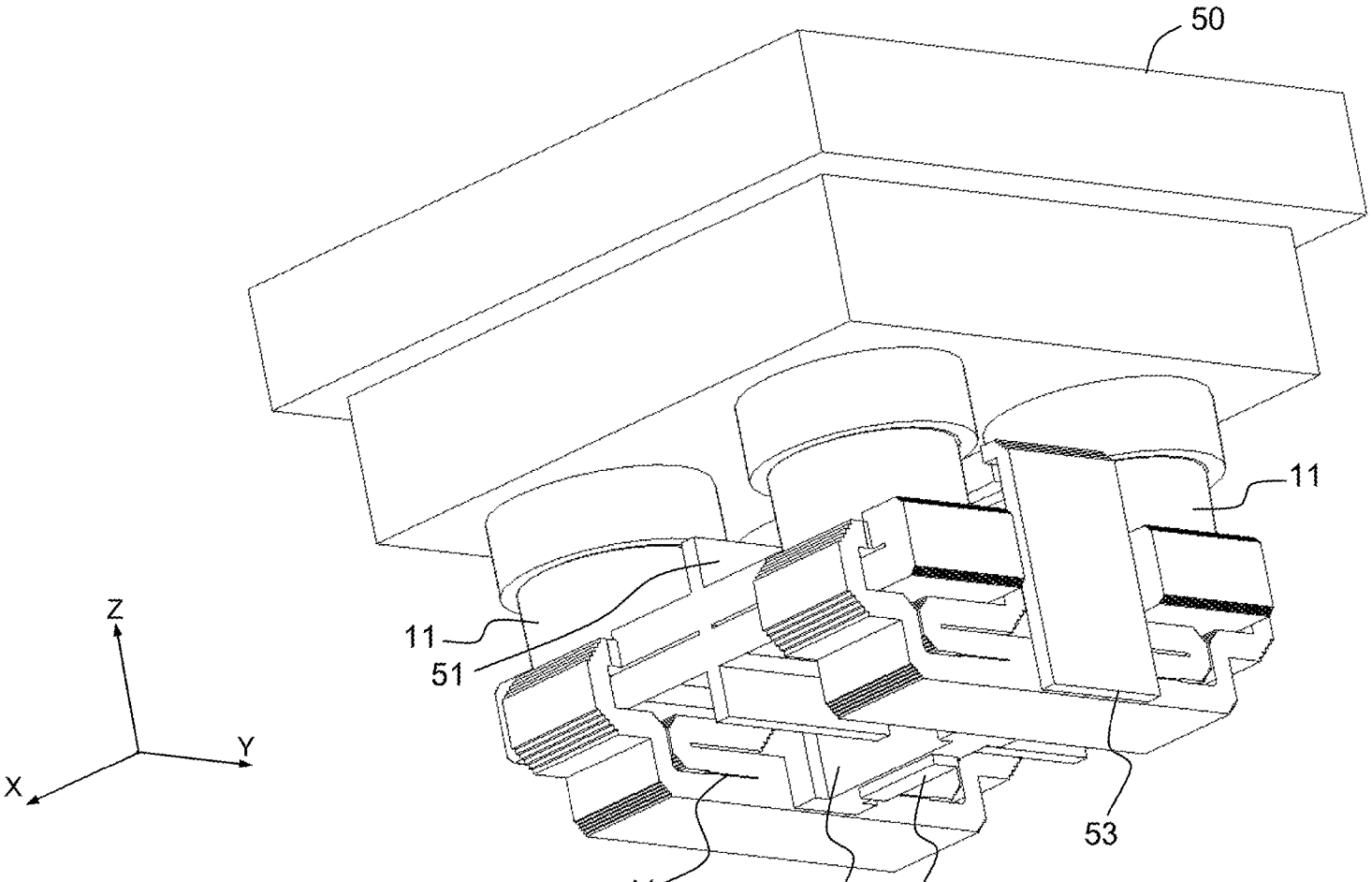
FIG. 4: a perspective diagram of an exemplary compact array of four compact excitation assemblies according to the invention.
Figure 5:
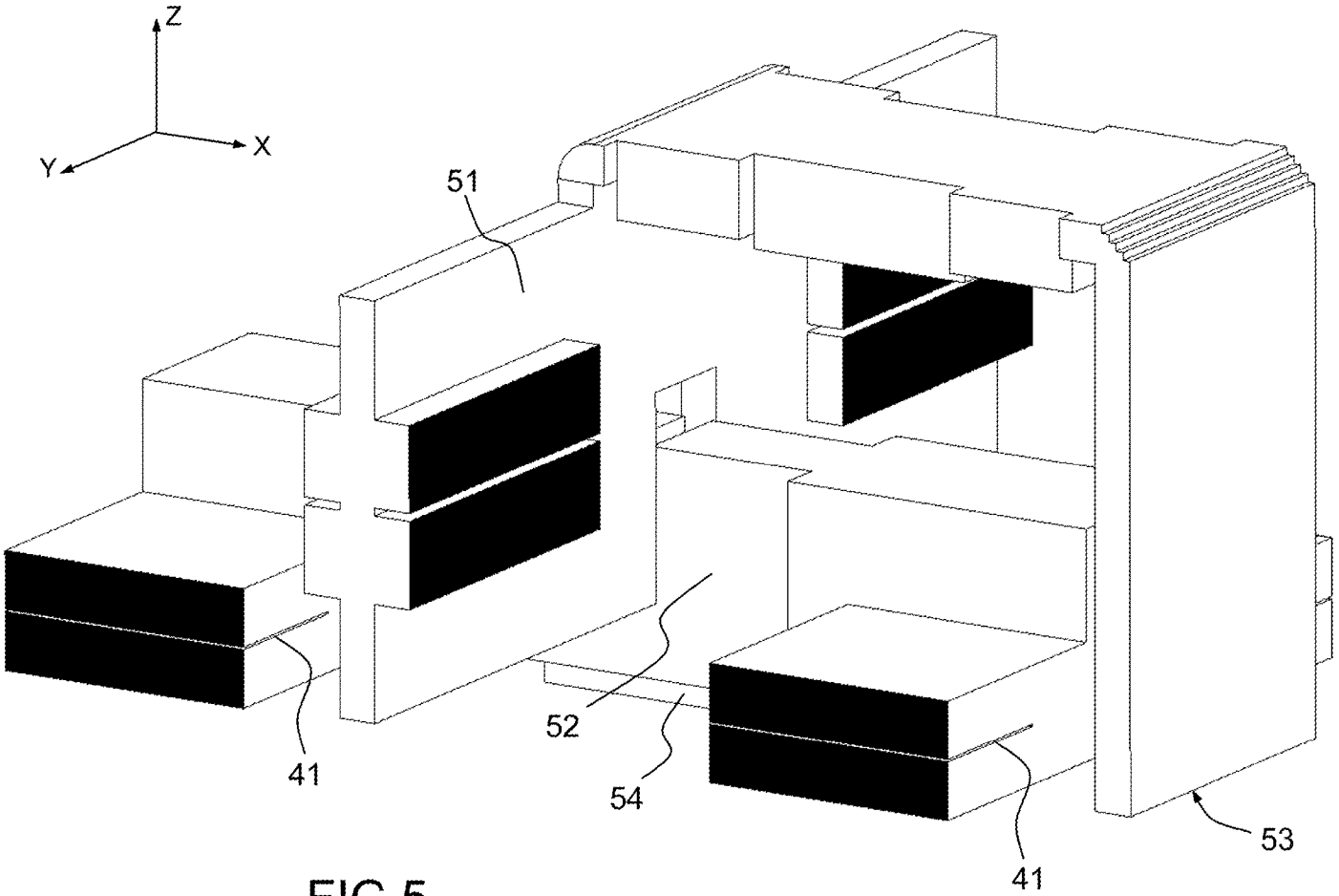
FIG. 5: a perspective schematic view of a first exemplary assembly of two different orthogonal splitters that can be used to supply four compact excitation assemblies according to the invention.
Figure 6:
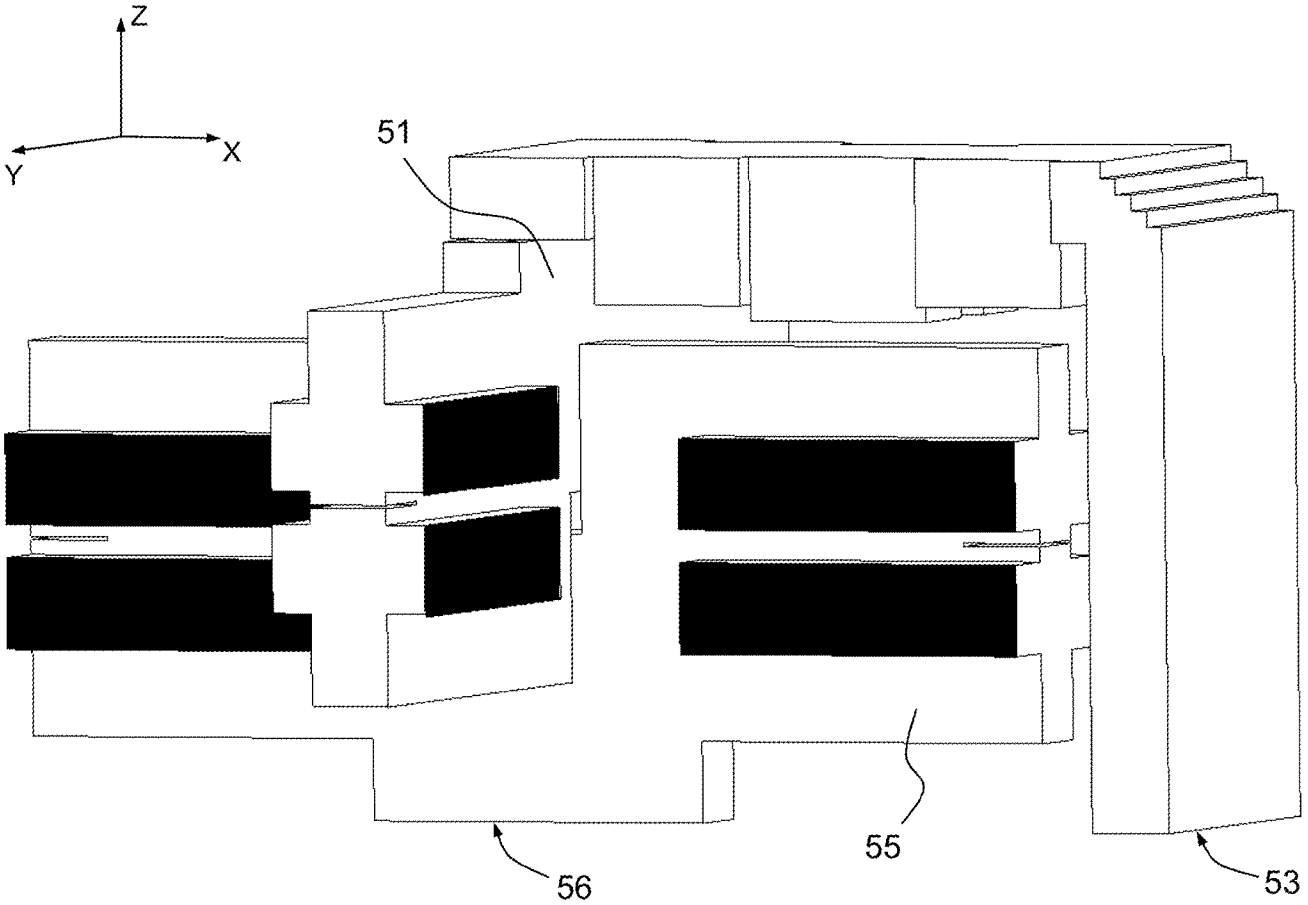
FIG. 6: a perspective schematic view of a second exemplary assembly of two identical orthogonal splitters that can be used to supply four compact excitation assemblies according to the invention.

Each compact excitation assembly can be used alone to supply an individual radiating element coupled at the output of the axial waveguide of the OMT. Alternatively, as illustrated in FIG. 4, several compact excitation assemblies can be coupled to one another in an array, for example in fours or sixteens, by using two orthogonal power splitters, independent of one another, and fitted one above the other, the two power splitters being respectively dedicated to the two orthogonal polarizations P1 and P2 and common to all the OMTs of the array. FIG. 5 illustrates a first exemplary assembly of two orthogonal power splitters in which the two power splitters 51, 52 are not identical because they are dedicated to two different frequency bands, for example Rx and Tx. FIG. 6 illustrates a second exemplary assembly of two orthogonal power splitters in which the two power splitters 51, 55 are identical because they are dedicated to two identical frequency bands, for example Tx. The two different power splitters 51, 52, or the two identical power splitters 51, 55, are respectively connected to the four OMTs of the array via connection waveguides and ensure the splitting and the dividing, or the combining, of the power between the different OMTs of the duly formed compact array. In FIG. 4, the compact array comprises four distinct OMTs coupled to one another by two orthogonal power splitters, common to all the OMTs, including dividers/combiners of power by eight. The different individual power splitters corresponding to one and the same polarization and dedicated to each OMT of the array are thus grouped together and incorporated in the common power splitter corresponding to said polarization. Each power splitter is respectively connected to all the OMTs of the array by the respective connection waveguides dedicated to each of the corresponding compact excitation assemblies. The compact array can be intended to supply a radiating feed 50 with four accesses having an aperture four times greater than an individual radiating element and operating in band C or, alternatively, to supply four individual radiating feeds. Each power splitter 51, 52, 55 comprises a respective input port 53, 54, 56 that can be linked to a respective supply source. The radiating feed 50, coupled to the output ports of the central waveguides 11 of the OMTs of the different excitation assemblies of the array can, for example, be a Fabry-Pérot cavity as in FIG. 4 in the case of an array of four compact excitation assemblies. Similarly, a compact excitation assembly of even greater aperture can be produced by linking 16 excitation assemblies in an array by two orthogonal power splitters including power dividers by thirty-two.

Although the invention has been described in conjunction with particular embodiments, it is clear that it is in no way limited thereto and that it comprises all the technical equivalents of the means described as well as the combinations thereof provided the latter fall within the scope of the invention.

The invention claimed is:

1. A compact bipolarization excitation assembly consisting of an orthomode transducer OMT comprising two transmission pathways, respectively dedicated to two orthogonal polarizations, a first power splitter and a second power splitter respectively connected to the two transmission pathways of the OMT, and a first connection waveguide and a second connection waveguide, the OMT consisting of a cross junction comprising a central waveguide parallel to an axis Z and four lateral ports respectively coupled to the central waveguide and oriented in two directions X and Y orthogonal to one another and to the axis Z, wherein the first power splitter consists of an input waveguide and of two output ports respectively coupled to a first and a second lateral port of the OMT, oriented in the direction X, via the first and the second respective connection waveguide, wherein the first power splitter is located on a first lateral side of the OMT, the input waveguide having a lateral wall orthogonal to the direction X and extending heightwise parallel to the axis Z, wherein the two output ports, respectively upper and lower, of the first power splitter are formed one above the other in the height of said lateral wall of the input waveguide, the upper output port being placed facing the first lateral port of the OMT to which the upper output port is connected by the first connection waveguide, and wherein the first and second connection waveguides have different electrical lengths, the difference in electrical length between the first and second connection waveguides being equal to a half-wavelength $\lambda/2$, where $\lambda$ is a central wavelength of operation.

2. The compact excitation assembly as claimed in claim 1, comprising several levels stacked parallel to a plane XY, the OMT and the first connection waveguide being located in a first level and the second connection waveguide consisting of a first linear section located in a second level, under the orthomode transducer, and of a second section bent to 180° connected to the second lateral port of the OMT.

3. The compact excitation assembly as claimed in claim 2, wherein a second power splitter structure is identical to a first power splitter structure and located on a second lateral side of the OMT, orthogonally to the direction Y.

4. The compact excitation assembly as claimed in claim 3, wherein the second power splitter consists of an input waveguide and of two output ports formed one above the other in a lateral wall of said input waveguide and respectively coupled to a third and a fourth lateral port of the OMT, oriented in the direction Y, via a third and a fourth respective connection waveguide, and wherein the third and fourth connection waveguides have different electrical lengths, the difference in electrical length between the third and fourth connection waveguides being equal to a half-wavelength $\lambda/2$.

5. The compact excitation assembly as claimed in claim 4, wherein the fourth connection waveguide consists of a third linear section located in a third level, under the orthomode transducer, and of a fourth section bent to 180° connected to the fourth lateral port of the OMT.

6. The compact excitation assembly as claimed in claim 5, wherein the OMT comprises a symmetrical pyramid situated at a center of the cross junction.

7. The compact excitation assembly as claimed in claim 2, wherein the second power splitter is a septum splitter consisting of an input waveguide provided with an inner wall, called septum, delimiting two output waveguides parallel to the input waveguide and stacked in a fourth level under the OMT, parallel to the plane XY, the two output waveguides of the septum power splitter being respectively connected to the first and second lateral ports of the OMT by fifth and sixth respective connection waveguides located in a third level, under the OMT, electrical lengths of the fifth and sixth connection waveguides being equal.

8. The compact excitation assembly as claimed in claim 7, wherein the OMT comprises a dissymmetrical pyramid situated at a center of the cross junction.

9. A compact array comprising at least four compact excitation assemblies as claimed in claim 1, the at least four compact excitation assemblies being coupled to one another by a first common power splitter and a second common power splitter, independent of one another, orthogonal to one another, and respectively dedicated to the two orthogonal polarizations, said first common power splitter grouping all the first power splitters of each compact bipolarization excitation assembly, and said second common power splitter grouping all the second power splitters of each compact bipolarization excitation assembly.

* * * * *